United States Patent [19]

Luyckx et al.

[11] 3,951,645

[45] Apr. 20, 1976

[54] STEELMAKING PRACTICE FOR PRODUCTION OF A VIRTUALLY INCLUSION-FREE SEMI-KILLED PRODUCT

[75] Inventors: Leon Luyckx, Peters Township, Washington County, Pa.; John R. Bell, Grosse Ile Township, Wayne County, Mich.

[73] Assignee: Jones & Laughlin Steel Corporation, Pittsburgh, Pa.

[22] Filed: Aug. 16, 1974

[21] Appl. No.: 497,999

[52] U.S. Cl. ..... 75/58; 75/129

[51] Int. Cl.[2] ..... C21C 7/02

[58] Field of Search ..... 75/58, 129

[56] References Cited

UNITED STATES PATENTS

| | | | |
|---|---|---|---|
| 3,107,995 | 10/1963 | Katakura | 75/129 |
| 3,131,058 | 4/1964 | Ototani | 75/58 |
| 3,219,438 | 11/1965 | Poole | 75/58 |
| 3,467,167 | 9/1969 | Mahin | 75/58 |
| 3,769,004 | 10/1973 | Barnhardt | 75/58 |
| 3,782,921 | 1/1974 | Glaesener | 75/58 |
| 3,793,000 | 2/1974 | Miltenberger | 75/58 |

*Primary Examiner*—Peter D. Rosenberg
*Attorney, Agent, or Firm*—Gerald K. White; T. A. Zalenski

[57] ABSTRACT

Total bath oxygen content and silicon input are controlled during a steelmaking process so that a cast and subsequently wrought product is characterized by being virtually free of elongated sulfide and silicate inclusions. Bendability properties of the wrought product are enhanced thereby.

8 Claims, 1 Drawing Figure

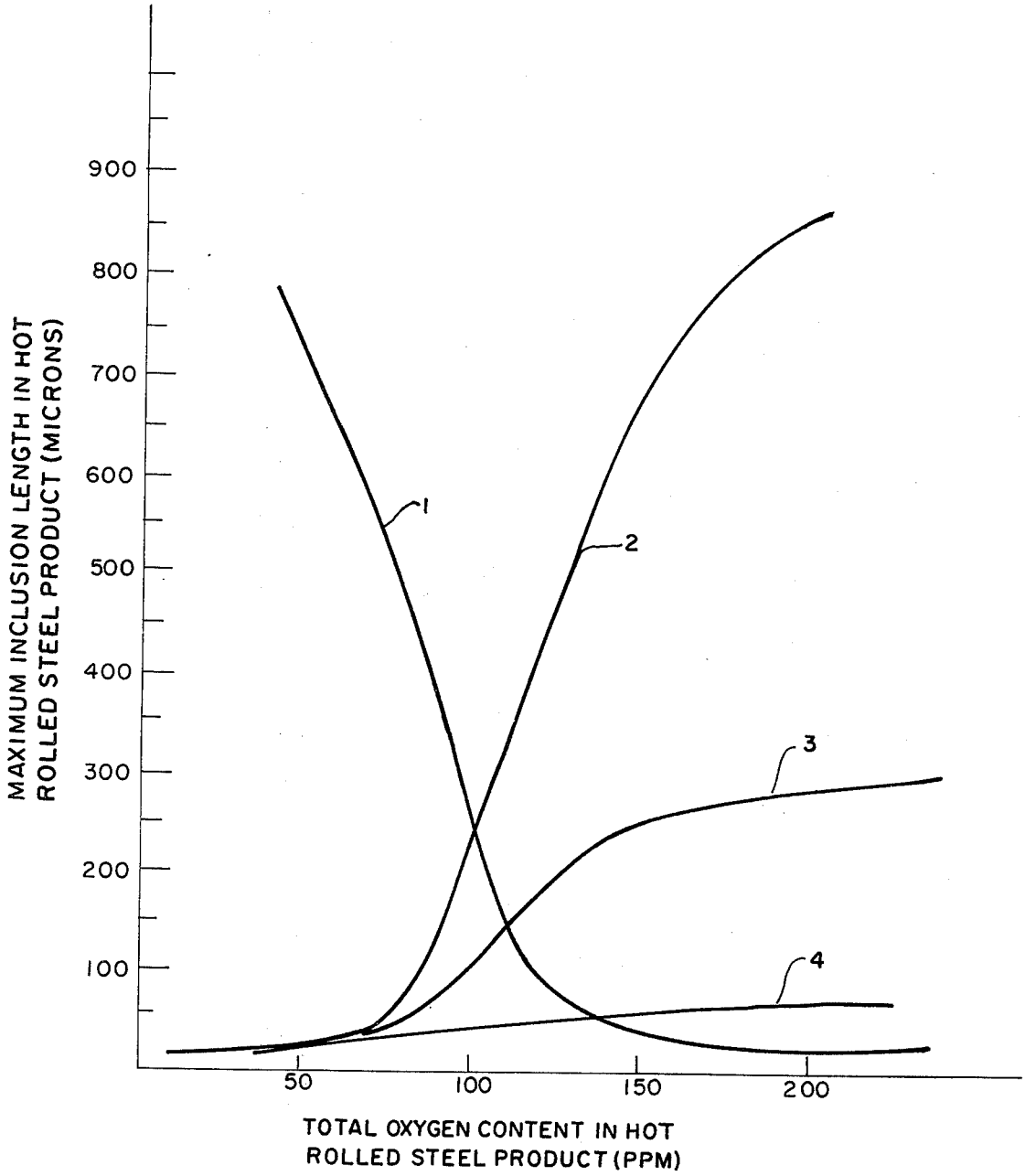
MAXIMUM INCLUSION LENGTH IN HOT ROLLED STEEL PRODUCT (MICRONS)
900
800
700
600
500
400
300
200
100
1
2
3
4
50
100
150
200
TOTAL OXYGEN CONTENT IN HOT ROLLED STEEL PRODUCT (PPM)

STEELMAKING PRACTICE FOR PRODUCTION OF A VIRTUALLY INCLUSION-FREE SEMI-KILLED PRODUCT

Our invention generally relates to a method of producing a semi-killed product that is virtually free of harmful elongated inclusions of the silicate and sulfide type when manufactured in the wrought state. The absence of elongated inclusions in such products ensures optimum cold formability, good bendability, and minimizes directionality of mechanical properties such a reduction of area, total elongation, bendability, toughness, etc.

Inclusion control has been the subject of intensive investigation in the art for some time as it has been generally recognized that inclusion control will aid in obtaining improved properties. For example, U.S. Pat. Nos. 3,119,688, 3,721,587 3,725,049 deal with control of silicate inclusions, and U.S. Pat. Nos. 3,387,968, 3,666,452, 3,666,570 and 3,671,336 relate to the control of sulfide inclusions. U.S. Pat. Nos. 3,119,688, 3,666,452, 3,666,570, and 3,671,336 relate to inclusion control in killed steels and for this and other reasons which will become apparent in later portions of our specification, do not teach one how to control inclusions for semi-killed steel products. On the other hand, U.S. Pat. Nos. 3,721,587 and 3,725,049 may relate to semi-killed steel products but do not relate either to the steelmaking procedure of our invention or specifically to sulfide control. U.S. Pat. No. 3,387,968 relates to the formation of globular sulfide inclusions for free-cutting steels. A relationship between sulfur and oxygen contents which lead to globular sulfide inclusions which are beneficial to machinability is presented therein. It is against this background of intensive activity that applicants have discovered a technique that will result in the production of a semi-killed wrought steel product that is virtually free of harmful elongated silicate and sulfide inclusions.

Our invention involves a series of interrelated steps which coact to produce a semi-killed wrought steel product which is virtually free of elongated silicate and sulfide inclusions. In order to achieve the desired result, there are several precautions which must be observed during the steelmaking practice.

Molten ferrous material, such as pig iron or scrap, is initially refined in a suitable commercially available steelmaking furnace into a molten intermediate steel product containing a maximum of about 0.10% carbon and about 0.008% silicon. This product is then tapped into a ladle for deoxidation and the addition of desired alloy additions such as carbon, manganese, columbium, vanadium, etc. In order to ensure that the desired silicate inclusion morphology will be obtained, it is essential that the deoxidizing agents and alloy additions contain a total weight of silicon that is no more than about 0.0005% of the weight of the refined molten steel. The refined steel is treated with a deoxidizing agent so as to obtain a semi-killed steel having a total oxygen content greater than about 100 ppm. in order to ensure that the desired sulfide inclusion morphology will be ultimately obtained. The alloyed, partially deoxidized molten steel is then teemed into a casting mold in a conventional manner. A casting having globular sulfide inclusions and virtually no silicate inclusions is produced. Following conventional mechanical working of the cast product, a wrought steel product having retained globular sulfide inclusions and virtually no silicate inclusions is obtained. In other words, the mechanical working does not cause the globular sulfide inclusions to become elongated.

It is thus an object of our invention to provide a steelmaking and hot working procedure capable of producing wrought semi-killed steel products characterized by the virtual absence of elongated sulfide and silicate inclusions.

It is also an object of our invention to produce wrought semi-killed products that are characterized by excellent cold formability, and in particular, good bendability, through control of steelmaking additions.

It is an additional objective to obtain a semi-killed wrought product in which the directionality of mechanical properties related to ductility is minimized.

These and additional advantages and objectives will become more apparent to those skilled in the art from the following description of the invention.

The FIGURE graphically represents the influence of total oxygen content in hot worked steels upon maximum sulfide inclusion length. Also, depicted by the graph is the influence of total oxygen content upon maximum silicate inclusion length at three silicon input levels. Such silicon input values represent silicon input after the refining stage.

For low and medium carbon steels of either the plain carbon or alloy type, elongated inclusions present after hot working are predominately of the sulfide type when the steel is in the aluminum killed condition, i.e., less than about 80 ppm total oxygen content. Elongated silicate inclusions are not a problem because they are reduced by aluminum during deoxidation by the following reaction:

$$2Al + MnO \cdot SiO_2 \rightarrow Al_2O_3 + Mn + Si$$

However, elongated sulfides are a problem in obtaining good formability of the wrought product due to the fact that manganese sulfide inclusions are elongated due to mechanical working. This problem has largely been overcome through recourse to the use of sulfide shape control agents such as the rare earths or zirconium. Examples of such prior art efforts are contained in U.S. Pat. Nos. 3,666,452, 3,666,570, and 3,671,336.

However, one desiring to achieve a highly formable product having a minimum degree of mechanical property directionality in the semi-killed condition is faced with a completely different problem than that encountered in the production of a killed product. The reason that semi-killed steels behave in a different manner than killed steels is related to the respective states of deoxidation. For the purposes of our invention, the deoxidation state may be conveniently defined with respect to the total oxygen content of the steel. Typically, killed steels contain oxygen contents below 80 ppm while semi-killed steels exhibit oxygen contents in the range of 80 to 150 ppm. Rimmed steels are characterized by oxygen content in excess of 150 ppm.

Keeping in mind the above described oxygen contents, the FIGURE is further useful to illustrate the mode of elongated inclusion control embodied in our invention. As previously mentioned, killed steel products are relatively free from the occurrence of troublesome silicate inclusions due to the reduction of $MnO \cdot SiO_2$ inclusions by aluminum. The formation of manganese sulfides, rather than manganese oxy-sulfides is also favored in killed steels because of the low total oxygen content. As the state of deoxidation is decreased from the killed to the semi-killed state, the formation of $MnO \cdot SiO_2$ inclusions are favored due to the relatively greater amount of oxygen available. As may also be observed, the amount (as expressed in terms of maximum length) of such silicate inclusions is dependent upon the amount (expressed as a precentage of total heat weight) of silicon contained in melt additives such as alloying and deoxidizing agents. Thus, the frequency of manganese silicate inclusions for semi-killed steels can only be minimized by control of the silicon content of the additive. This is unlike the situation involving killed steels where the oxygen portion of the inclusion is restricted so as to minimize the formation of silicate inclusions, and, thus, silicon control of the addition agents is a relatively unimportant factor.

Unlike silicate inclusions which become elongated during hot working, all types of sulfide inclusions do not elongate during hot working. Manganese oxy-sulfides will retain their globular shape due to their high melting point and consequent low plasticity during hot working. On the other hand, manganese sulfides exhibit higher plasticity during hot rolling, and therefore, become elongated when the steel is subjeced to hot working. As may be observed from the FIGURE, higher total oxygen contents lead to a lower incidence of elongated sulfide inclusions. This observation is believed to be due to the relative plasticities of manganese sulfides and manganese oxy-sulfides. Hence, one concerned with inclusion morphology control in wrought semi-killed steel products may advantageously utilize higher oxygen contents if silicon input is minimized in order to simultaneously control both types of inclusions.

Within the framework of the above discussed theory of the invention, we have discovered certain operational limits or constraints that should be incorporated into our steelmaking process in order to take maximum advantage of the underlying phenomena which control inclusion morphology. The adoption of such limits in a steelmaking process will ensure the repetitive ability to manufacture a wrought semi-killed product having bendability and directional uniformity that is greatly improved from commercially available semi-killed wrought steel products. As an example of the bendability properties of hot-rolled sheet obtained in accordance with the invention, transverse samples may be bent over a minimum bend radius of 0.5 R/T without edge cracking when evaluated by the Hutchinson Bend Test. This testing technique involves the bending of samples containing sheared edges, and, hence, is sensitive to inclusion content.

The first step in our process at which beneficial influence upon inclusion control can be exerted is in the refining portion of the steelmaking process where molten ferrous material containing carbon and silicon is refined into molten steel through oxidation of carbon and silicon. Steelmaking processes suitable for performing this step include such well-known commercially available techniques as the open hearth process, the electric furnace process, the Basic Oxygen process, the Bessemer process, etc. The refined molten steel at this stage of the process should contain a maximum of 0.10% carbon and 0.008% silicon. The reason for so restricting the carbon and silicon contents is to maintain silicon at a sufficiently low level so as to avoid subsequent silicate formation. However, one cannot simply select a desired silicon level without also controlling the carbon as the presence of carbon influences the amount of silicon which may be present in the refined steel. In general, as the carbon content is lowered, the silicon content will also be lowered. In this regard, it has been determined that a maximum of 0.10% carbon must be attained in order to also achieve a maximum silicon content of no more than 0.008%. The slicon content of the bath is also influenced by the activity of silica in the slag according to the following relationship:

$$\frac{a_{Si}}{(a_c)^2 \times a_{SiO_2}} = K$$

where $a_C$ = carbon activity in bath;

$a_{Si}$ = silicon activity in bath;

$a_{SiO_2}$ = $SiO_2$ activity in slag; and $K$ = a constant which varies with temperature.

The $SiO_2$ activity is related to the composition of the steelmaking slag and should be maintained on the order of 0.1 to 0.2 so as to obtain the desired silicon content in the bath.

Although a 0.10% maximum carbon content and a 0.008% maximum silicon content are operative for the purposes of our invention, it is preferred to maintain the maximum carbon and silicon levels at 0.08 and 0.005%, respectively for the purpose of further ensuring that silicate inclusions will be minimized. Better results will be obtained at maximum carbon and silicon levels of 0.06 and 0.003%, respectively. However, beyond this maximum level there is little incentive to continue lowering carbon and silicon levels because of two factors. First of all, the rate at which the silicon content decreases with decreasing carbon content lessens significantly below about 0.06% carbon and, hence, improvement in silicate prevention is minimal at lower carbon levels. Secondly, steelmaking processes become considerably more expensive when carbon levels below about 0.05 or 0.06% are desired.

Following completion of the furnace refining of the ferrous material, the molten steel is tapped into a ladle or other suitable vessel while deoxidation alloying additions are made to the steel in order to obtain the final desired chemical composition. Such additions are commonly made while the ladle is being filled. Typical alloying constituents may include columbium, vanadium, manganese, carbon, as well as other commonly added elements. The addition of carbon at this stage is necessary in the event that it is desired to increase the carbon content above the low level achieved in the refining stage. Thus, recarbonization of the steel is an oftentimes necessary expedient.

Although our invention is applicable for the production of a wide variety of plain carbon and alloyed semi-killed steels, the following general compositional limits are representative of steels in which our invention is particularly adapted because their end use involves applications in which cold formability and bendability are of importance.

| Element | General Range (%) | Preferred Range (%) | Optimum Range (%) |
|---|---|---|---|
| Carbon | 0.04/0.20 | 0.08/0.12 | — |
| Manganese | 0.25/1.5 | 0.4/0.8 | — |
| Sulfur | 0.030 max. | 0.020 max. | 0.015 max. |
| Phosphorous | 0.10 max. | 0.04 max. | — |
| Columbium | 0.01/0.12 | 0.02/0.06 | — |
| Vanadium | 0.04/0.15 | 0.05/0.12 | — |

Columbium and vanadium may or may not be present in the above listed steel composition and also may or may not be present together.

In order to consistently achieve a final semi-killed wrought product which is virtually free of elongated silicate inclusions, it is essential that the amount of silicon contained in the alloying additions be carefully controlled to a level which will not be sufficient to form detrimental silicate inclusions. In this regard it is pointed out that silicate control has been initially influenced by control of silicon content after the completion of refining and that control of the silicon content of the alloy additions further serves to control the formation of silicate inclusions. Both types of control are essential to the ultimate success of the process. In other words, one cannot exceed either process constraint and achieve a virtually silicate-free wrought semi-killed product.

In particular, the weight of silicon in the additive must not exceed about 0.005% of the weight of the refined steel in order to effect significant silicate control. This aspect is clearly indicated in the FIGURE by a comparison of Curves 2, 3, and 4 which represent silicon weights of 0.005, 0.0005, and 0.0002%, respectively, of the total refined metal weight. Curve 3 depicts acceptable silicate control while Curve 2 denotes unacceptable silicate levels. Curve 4 (0.0002% silicon weight) represents a preferred embodiment of the invention because the rather abrupt inclusion length rise with increasing total oxygen content is minimized.

The reason for restricting the relative amount of silicon contained in the alloy additions is believed to be related to a so-called mass effect. Because the silicon contained in the addition alloy is concentrated in a relatively small mass, there is a tendency for such localized concentrations of silicon through combination with oxygen, to form silicates at localized areas in the melt although a consideration of equilibrium effects would tend to predict otherwise.

Preceding the initial addition of alloying elements to the melt, the refined steel is at least partially treated with a deoxidizing agent. It is also essential to control the silicon content of the deoxidation agent in the same manner and for the same reasons as in the alloy additon step, i.e., by control of the amount of silicon in the deoxidant. This procedure further ensures that harmful silicate inclusions will not be formed. Deoxidation treatment also marks the onset of positive sulfide control and, hence, serves a dual function in overall inclusion control.

The deoxidation and alloy addition steps may be performed in several different manners or sequences and still fall within the scope of the invention. For example, the entire amount of deoxidizing agent necessary to achieve a semi-killed condition may be added to the ladle while tapping the refined steel into the ladle prior to the addition of alloying agents. On the other hand, a partial amount of the total required deoxidant may be added initially and then followed by the further addition of alloying and deoxidation agents. As will be understood by those skilled in the art, such further additions may be made in various sequences and increments as the ladle is filled. Moreover, such further additions may be made concurrently if desired. The most important aspect of the ladle addition practice is that at least a portion of the deoxidation agent is added before the start of any alloy additions. Such procedure further ensures that possible silicate formation during the alloying step will be suppressed due to the further minimization of bath oxygen content.

Prior to discussing the deoxidation control practice of the invention, it should be useful to further discuss the various curves plotted in the FIGURE. A relationship between maximum inclusion length and total oxygen content was determined from the results of seven trails in which low carbon steel having an aim of about 0.5% manganese. All deoxidation was conducted with the use of essentially pure aluminum. Pertinent steelmaking data is included in Table I. Based upon the oxygen content and microscopic evaluation of coils produced from the trials listed in Table I, the curves 1, 3 and 4 shown in the FIGURE were prepared. Data for curve 2 were obtained following a conventional aluminum semi-killed practice using regular ferromanganese containing about 1.0% silicon (approximately 0.005% silicon based upon total heat weight).

Curve 1 represents maximum sulfide inclusion length as a function of total oxygen content in the final hot-rolled product. As may be observed, sulfide length generally decreases with increasing oxygen content throughout the range of total oxygen contents for killed (up to 80 ppm) and semi-killed (80 to 150 ppm) steels. An inflection point, indicative of changed behavior, exists at approximately 100 ppm oxygen. This point may be related to the tendency to favor the formation of desirable manganese oxy-sulfides rather than elongatable manganese sulfides. Curves 2, 3 and 4 represent the effect upon inclusion length of various silicon addition levels in the manganese alloy ladle addition step as a percentage of total heat weight with total oxygen content. Curve 2 represents a silicon addition of 0.005%. Curve 3 is representative of a silicon addition of 0.0005%. The effect of silicon addition of 0.0002% is depicted in Curve 4. As may be seen, the amount of silicon added to the bath has a striking effect upon silicate formation and for, oxygen levels in excess of killed steel levels a rather abrupt increase is noted. This indicates that silicon control is an important factor for semi-killed steels.

The degree of deoxidation is controlled by adding an amount of deoxidizer that will result in a semi-killed product having a total dissolved oxygen content greater than about 100 ppm. The reason for restriction of the oxygen content to only a portion of the range normally encountered in semi-killed products is related to the avoidance of elongated sulfide inclusions. As can be observed from the FIGURE, the formation of elongated sulfides is minimized to a large extent at oxygen levels greater than about 100 ppm. This is believed to be because manganese oxy-sulfides rather than manganese sulfides are formed at such oxygen levels. Although both sulfide types are globular or oval shaped in the cast product, only manganese oxy-sulfides exhibit low plasticity during hot working. Therefore, by maintaining the oxygen content at a sufficiently high level to form manganese oxy-sulfides, the globular or oval sulfide shape is retained in the wrought product.

related to different oxygen levels in the respective types of steel, i.e., titanium and zirconium only combine with sulfur in killed steels because of a relative oxygen deficiency. Aluminum, however, is a preferred deoxidation agent because of its low cost and wide availability.

It is also important to note that ultimate silicate inclusion morphology does not correlate with the residual silicon content of the final product. The morphology only correlates with the tap silicon content and the amount of silicon in the alloy and deoxidation additives as a percentage of total heat weight. In fact, the low

TABLE I

| | | | | | STEELMAKING DATA | | | | | | | | |
|---|---|---|---|---|---|---|---|---|---|---|---|---|---|
| | | Tap (%) | | | Ladle Additions | | Ladle Test (%) | | | | Pouring Platform Practice | | |
| Trial No. | Heat | C | Mn | Slag FeO (%) | Aluminum | Mn (lbs.) | C | Mn | Si | Al | Ingot No. | Al lb/T | Top Condition |
| 1 | 941789 | .090 | — | 18.4 | 1.0 lb./T | 2500 (1) | .14 | .48 | .007/ .009 | .005 | 1 | 0.00 | Heavy bleeder |
| | | | | | | | | | | | 2 | 0.08 | Heavy bleeder |
| | | | | | | | | | | | 3 | 0.13 | Light bleeder |
| | | | | | | | | | | | 4–6 | 0.16 | Medium bleeder |
| | | | | | | | | | | | 7–9 | 0.18 | No bleeder |
| | | | | | | | | | | | 10 | 0.13 | Light bleeder |
| 2 | 954148 | .080 | — | 20.1 | 1.56 lb./T | 2200 (1) | .16 | .48 | .013/ .014 | .006 | 1–9 | 0.00 | Flat tops |
| 3 | 955902 | .096 | .16 | 21.4 | 1.4 lb./T | 1700 (2) | .12 | .44 | .014 | .009 | 1–9 | 0.00 | Flat tops |
| 4 | 955932 | .075 | .14 | 25.8 | 1.4 lb./T | 1600 (2) | .09 | .40 | .010 | .006 | 1 | 0.00 | Heavy bleeder |
| | | | | | | | | | | | 2 | 0.16 | Heavy bleeder |
| | | | | | | | | | | | 3–4 | 0.19 | Medium bleeder |
| | | | | | | | | | | | 5 | 0.29 | Medium bleeder |
| | | | | | | | | | | | 6–7 | 0.29 | No bleeder |
| | | | | | | | | | | | 8 | 0.29 | Light bleeder |
| | | | | | | | | | | | 9 | 0.29 | Medium bleeder |
| | | | | | | | | | | | 10 | 0.34 | No bleeder |
| 5 | 956910 | .070 | .14 | 17.8 | 1.55 lb.T | 2100 (2) | .14 | .49 | .014 | .007 | 1 | 0.00 | Medium bleeder |
| | | | | | | | | | | | 2–3 | 0.09 | Medium bleeder |
| | | | | | | | | | | | 4 | 0.20 | Flat top |
| | | | | | | | | | | | 5–7 | 0.15 | Flat top |
| | | | | | | | | | | | 8 | 0.12 | Light bleeder |
| 6 | 945567 | .055 | .08 | 32.5 | 1.88 lb./T | 2000 (2) | .11 | .37 | .008 | .007 | 1 | 0.10 | Heavy bleeder |
| | | | | | | | | | | | 2 | 0.20 | Heavy bleeder |
| | | | | | | | | | | | 3 | 0.30 | Heavy bleeder |
| | | | | | | | | | | | 4–8 | 0.50 | Flat or light bleeder |
| 7 | 957046 | .15* | .18* | 18.7* | 1.3 lb./T | 2000 (2) | .14 | .48 | .011 | .008 | 1 | 0.00 | Medium bleeder |
| | | | | | | | | | | | 2 | 0.10 | Flat top |
| | | | | | | | | | | | 3 | 0.15 | Flat top |
| | | | | | | | | | | | 4 | 0.25 | Medium bleeder |
| | | | | | | | | | | | 5 | 0.20 | Heavy bleeder |
| | | | | | | | | | | | 6 | 0.25 | Medium bleeder |
| | | | | | | | | | | | 7–9 | 0.25 | Light bleeder |

*Heat reblown 20 seconds after tests taken (estimated to be .11% C)
(1) Electrolytic Manganese (0.001% max. Si content in additive)
(2) "ELS" Manganese (0.10% max. Si content in additive)

However, at dissolved oxygen levels in excess of 100 ppm, manganese silicate stringers become the prevalent type of non-metallic inclusions. Thus, but for the silicate control effected by the invention, reductions in elongated sulfides would be offset due to increases in elongated silicates. On the other hand, elongated sulfide control cannot be practically effected at oxygen levels below about 100 ppm although such levels have a beneficial effect upon silicate control. By virtue of deoxidation control and silicon control, we have discovered that total inclusion control can be effected over a rather substantial range of oxygen contents that occur for semi-killed steels to an extent that cold fabricability and bendability is enhanced.

Suitable deoxidizing agents for use in the invention include aluminum, titanium, zirconium, and admixtures thereof. These agents, of course, must not include silicon in excess of the above stated amount. When used as deoxidizers in semi-killed steels, titanium and zirconium do not behave in the same manner as when introduced into killed steel baths, i.e., they do not function as sulfide control agents. Rather, such additives combine with oxygen, and, thus, deoxidize the steel. The reason for such different behavior is believed to be silicon input of the additions and the cleanliness of the steel are not necessarily reflected by residual silicon content. Up to 0.015% silicon can be picked up in the steel as a result of a reaction of the residual aluminum with the ladle lining or ladle glaze. This condition is believed to be due to the following reaction:

$$4Al + SiO_2 \rightarrow 2\ Al_2O_3 + 3\ Si$$

Silicon pick-up occurs after steel deoxidation and does not result in the formation of manganese silicate inclusions. Therefore, the produuct of the invention is essentially silicate free but not necessarily silicon free.

It is self-evident that it is comparatively more difficult to control a deoxidization practice that is directed to only a portion of the overall semi-killed range of oxygen contents than it is to merely obtain a semi-killed product. This problem is compounded by the fact that the deoxidant to be used in the invention must be essentially silicon-free because, in the past, some silicon intentional addition has been used in the production of aluminum semi-killed steels. Such silicon additions serve as a buffering agent to aid in control of the practice as silicon will also combine with oxygen; although to a lesser extent than aluminum. Partial oxygen control through use of a silicon buffer addition permits the use of tap carbon measurements to serve as a reasonable indicator of the required amounts of aluminum addition. In the absence of a buffer addition, the uncertainty of the necessary quantity of aluminum or other strong deoxidizer addition, based upon tap carbon content, is much greater and, thus, the probability of having to make additional aluminum additions to the mold is increased. Chromium additions made prior to the aluminum addition serve to buffer the steel to the extent that compensation for the lack of silicon in the deoxidizing agent may be made. A refined steel having a chromium content of 0.05 to 0.20% at tap will be sufficiently buffered so as to improve subsequent deoxidation control. Adequate buffering will also be obtained by columbium contents of from 0.01 to 0.12% when added during the alloy addition stage of our process.

Appropriate criterion for measuring the degree of deoxidation control for aluminum semi-killed steels are the amount of aluminum that must be added to the ingots in order to control mold action and the ingot to slab yield. If ladle deoxidation is incomplete, the steel will have a moderate rimming action in the mold. Such action must then be controlled through use of further aluminum additions to the mold. In the event that a semi-killed steel is permitted to rim for an excessive amount of time, a spongy top will be developed in the cast ingot thereby reducing the yield of usable product. On the other hand, overdeoxidation caused by adding excessive amounts of aluminum also reduces ingot to slab yields because of the development of piped ingots.

through the use of buffering agents such as chromium and/or columbium.

Only three of the trials utilizing chromium or chromium plus colubium as buffering agents required aluminum mold additions. The mold additions were 53 oz. per ingot for trial 8, 10 oz. per ingot for trial 13, and 6 oz. per ingot for trial 14. Trials 8 and 13 were made in a basic oxygen furnace and were subjected to reblows. An analysis of the steelmaking trial records indicated that the ladle aluminum addition was actually less than the scheduled amount. As a result, trials 8 and 13 were under-deoxidized in the ladle and, consequently, aluminum mold additions were required to correct for the error in the ladle addition of aluminum. The ladle aluminum addition for trial 8 was low by approximately 0.3 lbs. per ton while trial 13 was low by 0.05 lbs. per ton. Therefore, it may be seen that the need for mold additions for these trials were primarily due to error correction instead of a lack of control of the deoxidation practice itself. Trial 14 required aluminum mold additions because slag that formed on the ingot tops prevented the tops from solidifying. Thus, small amounts of aluminum were added to 5 of the 13 ingots of this trial so as to cause the ingot tops to solidify rather than to control mold action per se. Trial 8 was outside of the normal deoxidation practice, and, thus, the ingot behavior and yield cannot be considered as truly typical. The abnormalities in trials 13 and 14 were minor and are thereby considered to fall within the expected behavior pattern of the buffered practice. However, even including the data from trial 8, it is apparent that buffereing may be advantageously employed with the invention.

Buffering also appears to lead to improved results

TABLE II

CHEMICAL COMPOSITION AND DEOXIDATION CONTROL DATA FOR SILICATE-FREE SEMI-KILLED STEELS

| Trial | C | Mn | Si | Al | Cr | Cb | Average Mold Al oz/ingot | Ingot to Slab Yield % |
|---|---|---|---|---|---|---|---|---|
| 1 | .14 | .48 | .008 | .005 | — | — | 80 | 82.9 |
| 2 | .16 | .48 | .013 | .006 | — | — | 0 | 86.3 |
| 3 | .12 | .44 | .014 | .009 | — | — | 0 | 85.3 |
| 4 | .09 | .40 | .010 | .006 | — | — | 96 | 84.8 |
| 5 | .14 | .49 | .014 | .007 | — | — | 48 | 87.2 |
| 6 | .11 | .37 | .008 | .007 | — | — | 152 | 84.8 |
| 7 | .14 | .48 | .011 | .008 | — | — | 72 | 85.3 |
| 8 | .15 | .42 | .013 | .005 | .10 | — | 53 | 85.1 |
| 9 | .09 | .61 | .017 | .006 | .12 | .030 | 0 | 84.7 |
| 10 | .07 | .54 | .009 | .007 | .12 | .029 | 0 | 88.1 |
| 11 | .07 | .60 | .014 | .006 | .12 | .030 | 0 | 86.8 |
| 12 | .09 | .60 | .015 | .003 | .19 | .025 | 0 | 86.2 |
| 13 | .13 | .44 | .014 | .006 | .11 | — | 10 | 86.5 |
| 14 | .09 | .54 | .018 | .009 | .11 | .027 | 6 | 88.6 |

Table II lists the results of seven trial heats in which no buffering was performed and seven heats in which buffering with chromium alone or chromium with columbium was effected. The data reflecting ingot to slab yield contains only data from slabs which were cut to a maximum length because the inclusion of slab data concerning slabs cut to a specific length would not necessarily reflect the maximum obtainable yield.

The average aluminum addition to the mold for the seven nonbuffered trials was 64 oz. per ingot. The range of aluminum additions was from 0 to 152 oz. per ingot. The seven buffered trials required an average aluminum addition of about 10 oz. per ingot and had a range of from 0 to 53 oz. per ingot. This data reflects the improved deoxidation control made possible with regard to slab yields. The average ingot to slab yield for the non-buffered trials averaged 85% as compared with those for buffered trials which averaged 87.5%. This increase in yield, while only approximately 2% is highly significant on an annual tonnage basis. Moreover, the range of yields for the buffered trials was lower than for the non-buffered trials. This factor is believed to also indicate that buffering promotes deoxidation control.

Following deoxidation treatment, the molten steel is in a condition for being teemed into a mold in order to solidify into a cast product. Such step may be accomplished by any conventional technique. From a micro structural point of view, the semi-killed cast product is characterized by the presence of globular sulfide inclusions and the virtual freedom of silicate inclusions.

These micro structural characteristics are a result of the careful control of silicon content of the refined steel and in the alloying additive as well as deoxidation control within the limits specified above.

After its formation, the cast product is then mechanically worked so as to elongate the cast product. This step is conventionally referred to as hot working and may be accomplished by heating and then subjecting the casting to forging, rolling, extruding, etc. The wrought product is characterized by globular sulfide inclusions and the virtual freedom of silicate inclusions. A distinguishing feature of this product as compared to typical semi-killed steels is the absence of elongated sulfides. This is because the globular manganese oxysulfides formed as a result of deoxidation control do not elongate during hot working due to their inherent low plasticity. Of course, the low incidence of silicates is also not typical for most semi-killed products. Thus, one is able to produce a semi-killed steel product containing a minimal amount of elongated inclusions that may be bent to a substantial extent when contrasted with the normal semi-killed product.

Although it is generally recognized that killed plain carbon and high strength low alloy steels can be treated to produce an inclusion morphology characterized by globular sulfides and minimal silicates, it has not heretofore been recognized that semi-killed products having a comparable inclusion morphology could be produced. However, to produce such desirable morpholgy in semi-killed steels requires the use of higher oxygen contents instead of shape control agents to obtain globular sulfides and critical silicon control to reduce the occurrence of silicates. Of course, silicon control in killed steels is unnecessary due to the low oxygen values of killed steel products. From a cost standpoint, it is clearly desirable to produce plain carbon and low alloy steels in the semi-killed rather than the killed metallurgical state. The major reason for such preference is related to final product yield. The use of open topped rather than hot-topped molds provides a significant cost savings from the standpoints of casting cost and increased yields due to one not being required to crop off the hot top portion of the ingot. Secondly, yields are increased and the amount of intermediate product conditioning is lessened for semi-killed products when contrasted with killed products. This is because semi-killed products generally contain less surface defects than killed products.

We claim:

1. A method of producing a semi-killed wrought steel product virtually free of elongated sulfide and silicate inclusions comprising:

a. refining molten ferrous material containing carbon and silicon into molten steel containing 0.10% carbon maximum and 0.008% silicon maximum;

b. treating said molten steel with a deoxidizing agent containing a total weight of silicon that is no more than about 0.0005% of the weight of said molten steel so as to obtain a semi-killed steel having a total oxygen content greater than about 100 ppm to 150 ppm;

c. adding an alloying addition to said molten steel, said alloying addition containing a total weight of silicon that is no more than about 0.0005% of the weight of said molten steel;

d. teeming said molten steel into a mold to form a casting of said semi-killed steel so as to obtain a cast product having globular sulfide inclusions and virtually free of silicate inclusions; and e. mechanically hot working said cast product so as to obtain a wrought steel product virtually free of elongated sulfide and silicate inclusions and having good cold formability and bendability.

2. A method of producing a semi-killed wrought steel product virtually free of elongated sulfide and silicate inclusions according to claim 1, wherein:

said molten steel contains from about 0.05 to about 0.2% chromium.

3. A method of producing a semi-killed wrought steel product virtually free of elongated sulfide and silicate inclusions according to claim 2, wherein:

said alloying additions contain columbium in an amount which will result in a columbium content of 0.01 to 0.12% in said molten steel.

4. A method of producing a semi-killed wrought steel product virtually free of elongated sulfide and silicate inclusions according to claim 1, wherein:

said deoxidizing agent is a member selected from the group consisting of aluminum, titanium, zirconium, and admixtures thereof.

5. A method of producing a semi-killed wrought steel product virtually free of elongated sulfide and silicate inclusions according to claim 1, wherein:

said alloy addition and deoxidizing agent together contain a total weight of silicon that is no more than about 0.0002% of the weight of said molten steel.

6. A method of producing a semi-killed wrought steel product virtually free of elongated sulfide and silicate inclusions according to claim 1, wherein:

said molten ferrous material is refined into molten steel containing 0.08% carbon maximum and 0.005% silicon maximum.

7. A method of producing a semi-killed wrought steel product virtually free of elongated sulfide and silicate inclusions according to claim 1, wherein:

said cast product consists essentially of 0.04 to 0.20% carbon, 0.25 to 1.5% manganese, 0.030% sulfur maximum, 0.10% phosphorus, balance iron.

8. A method of producing semi-killed wrought steel product virtually free of elongated sulfide and silicate inclusions according to claim 7, wherein:

said cast product further consists essentially of a member selected from the group consisting of 0.01 to 0.12% columbium, 0.04 to 0.15% vanadium, and admixtures thereof.

* * * * *